US006609505B2

(12) United States Patent
Janson

(10) Patent No.: US 6,609,505 B2
(45) Date of Patent: Aug. 26, 2003

(54) TWO SPEED SUPERCHARGER DRIVE

(75) Inventor: David Allen Janson, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 09/683,055

(22) Filed: Nov. 13, 2001

(65) Prior Publication Data

US 2003/0089348 A1 May 15, 2003

(51) Int. Cl.[7] ..... F02B 33/00

(52) U.S. Cl. ..... 123/559.1; 123/561; 475/113; 477/110

(58) Field of Search ..... 123/559.1, 561; 60/607–608; 188/82.2; 477/110; 475/113, 150; 192/84.1

(56) References Cited

U.S. PATENT DOCUMENTS

| | | | | | |
|---|---|---|---|---|---|
| 1,977,553 | A | * | 10/1934 | Halford | 123/561 |
| 2,929,198 | A | * | 3/1960 | Crocchi | 60/608 |
| 3,739,572 | A | * | 6/1973 | Duerr | 60/607 |
| 4,030,583 | A | * | 6/1977 | Miller | 192/84.1 |
| 4,718,303 | A | * | 1/1988 | Fogelberg | 475/150 |
| 4,815,437 | A | * | 3/1989 | Regar | 123/561 |
| 4,827,798 | A | * | 5/1989 | Oldfield | 475/113 |
| 4,964,318 | A | * | 10/1990 | Ganoung | 477/110 |
| 5,133,188 | A | * | 7/1992 | Okada | 123/561 |
| 5,256,109 | A | * | 10/1993 | Winkelmann et al. | 123/561 |
| 5,275,261 | A | * | 1/1994 | Vranish | 188/82.2 |
| 5,427,079 | A | * | 6/1995 | Andrepont et al. | 123/561 |
| 5,875,766 | A | * | 3/1999 | Ozawa | 123/561 |
| 5,887,434 | A | * | 3/1999 | Arnell et al. | 123/561 |
| 6,082,340 | A | * | 7/2000 | Heimark | 123/559.1 |
| 2002/0096156 | A1 | * | 7/2002 | Palazzolo et al. | 123/559.1 |

FOREIGN PATENT DOCUMENTS

| | | | | | |
|---|---|---|---|---|---|
| JP | 02075734 | A | * | 3/1990 | F02D/23/00 |

* cited by examiner

*Primary Examiner*—Thomas Denion
(74) *Attorney, Agent, or Firm*—F. G. McKenzie

(57) ABSTRACT

A two speed supercharger system (20) for an internal combustion engine. The supercharger system includes a supercharger pump (40) that is driven by the engine via a gear box (34). The gear box includes two planetary gear sets (54, 70) and a controllable clutch (66). A controller (35) selectively activates the clutch to control the transition between the two speeds to assure a smooth transition without sudden changes in torque output.

14 Claims, 3 Drawing Sheets

TWO SPEED SUPERCHARGER DRIVE

TECHNICAL FIELD

The present invention relates to supercharger systems used with internal combustion engines and more particularly to centrifugal supercharger systems having variable speed drives.

BACKGROUND OF THE INVENTION

Superchargers employed to boost the power of internal combustion engines are well know. The supercharger systems typically include an air compressor that pulls in intake air and compresses it prior to being fed into the engine cylinders. This allows for a greater power output relative to the same size engine without a supercharger. The air compressor is conventionally driven by a belt that connects to a pulley on the shaft of the compressor and a pulley on the crankshaft of the engine. There may also be a fixed ratio gear set between the compressor and camshaft in order to obtain one desired gear ratio. So the rotational speed and thus the amount of compression depends solely upon the engine speed.

In particular, supercharged engines have advantages when used in vehicles. The advantage with superchargers is that the engine can produce more power, so for a given desired power output, the engine with a supercharger can be smaller, thus generally lighter weight and having better fuel economy. The drawback is that the centrifugal supercharger system does not provide much increase in pressure for the intake air at low engine RPMs.

Some have attempted to resolve this problem. One attempt to overcome the drawbacks of a centrifugal supercharger system employed a continuously variable belt drive between the drive pulley and the driven pulley of the compressor in order to vary the drive ratio. It used a belt mounted on cone pulleys. A pair of cones on each pulley could be pushed together and pulled apart to vary the drive ratio for the belt. But this proved to be too complicated and unreliable.

Further, it is advantageous to have the centrifugal supercharger system operate without causing a discontinuity in the torque and horsepower. These types of discontinuities can cause the engine to surge or lug down, which is generally objectionable to vehicle occupants.

Thus, it is desirable to have a centrifugal supercharger system that overcomes the drawbacks of the conventional centrifugal supercharger system. In particular, it is desirable to have a system with a variable drive ratio, in order to improve an engine's torque at low RPMs, while avoiding the cost, complexity and unreliability of previous attempts to produce such a system. And, preferably, the variable drive ratio does not cause discontinuities in the torque or horsepower output.

SUMMARY OF THE INVENTION

In its embodiments, the present invention contemplates a system for variably controlling the rotational velocity input to a supercharger compressor that is operatively coupled to an internal combustion engine. The system includes an input shaft adapted to couple to a rotating member of the engine, and a first planetary gear set including a first sun gear, a first ring gear, and a first planet carrier having a first set of planetary gears mounted thereon and meshing with the first sun gear and the first ring gear, with one of the first sun gear, the first ring gear and the first planet carrier rotationally coupled to the input shaft. The system also includes a clutch mechanism having a first portion that is rotationally fixed relative to the engine, and a second portion that is selectively rotationally fixed relative to the first portion, with the second portion being rotationally coupled to one of the first sun gear, the first ring gear and the first planet carrier that is not coupled to the input shaft. A one-way clutch is coupled between one of the first sun gear, the first ring gear and the first planet carrier that is coupled to the input shaft, and another of the first sun gear, the first ring gear and the first planet carrier that is not coupled to the input shaft. A second planetary gear set includes a second sun gear, a second ring gear and a second planet carrier having a second set of planetary gears mounted thereon and meshing with the second sun gear and the second ring gear, with one of the second sun gear, the second ring gear and the second planet carrier rotationally fixed to one of the first sun gear, the first ring gear and the first planet carrier that is not directly rotationally coupled to the input shaft. An output shaft is adapted to couple to an input shaft to a supercharger and coupled to one of the second sun gear, the second ring gear and the second planet carrier; and a controller selectively actuates the clutch mechanism.

The present invention further contemplates a method for controlling the input speed to a drive shaft of a supercharger pump coupled to an internal combustion engine comprising the steps of: receiving input torque from a rotating member of the engine; providing a gear set shiftable between a higher gear ratio and a lower gear ratio; providing a clutch for causing a shift between the higher gear ratio and lower gear ratio; variably controlling the clutch while shifting back and forth between the higher gear ratio and the lower gear ratio to provide a smooth transition in torque output for the internal combustion engine; and providing an output member coupled between the gear set and the supercharger pump.

Accordingly, an object of the present invention is to provide a supercharger system for an internal combustion engine that includes a two speed gearbox between the drive pulley on the engine and the driven pulley on the compressor.

Another object of the present invention is to provide supercharger system for an internal combustion engine that includes a two speed gearbox with a variable controlled clutch.

An advantage of the present invention is that an engine with a two speed supercharger drive system will allow for improved vehicle torque at low engine RPMs while maintaining its efficiency at high engine RPMs.

Another advantage of the present invention is that the two speed supercharger drive is a low cost and reliable system for providing improved engine performance.

A further advantage of the present invention is that the drive ratio of the supercharger can be changed without a sudden torque or horsepower discontinuity by variably controlling a shift clutch coupled to the gear set.

DETAILED DESCRIPTION OF THE PREFERRED EMBODIMENTS

Figure 1:
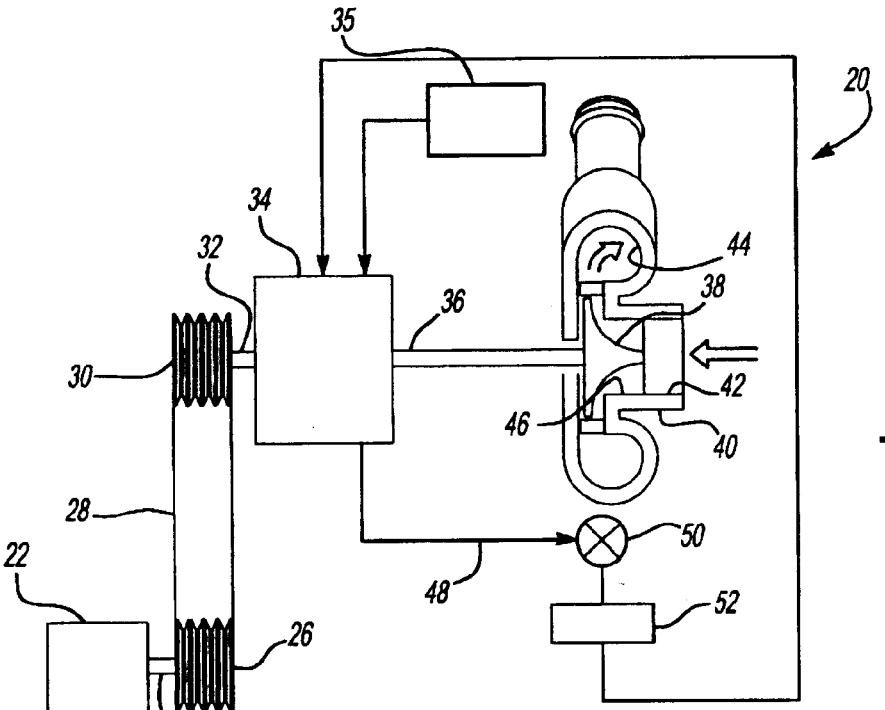
FIG. 1 is a schematic representation of a supercharger system in accordance with the present invention.

FIG. 1 illustrates a supercharger system 20 that connects to and is driven by an internal combustion engine 22. The engine 22 includes a crankshaft 24, which includes a drive pulley 26 affixed to one end. A belt 28 connects the drive pulley 26 to a driven pulley 30, which drives the input shaft 32 to a gearbox 34. A controller 35 is electrically connected to a clutch in the gearbox 34. Preferably, the controller 35 works in combination with the engine controller, not shown, to coordinate the operation of the clutch with other engine operations. The internal components of the gearbox 34 and its clutch will be described below with reference to FIGS. 2 and 3.

The gearbox 34 has an output shaft 36, which drives an impeller 38 of a centrifugal air pump (supercharger) 40. The pump 40 includes an air intake 42, a compression chamber 46, and an air outlet 44 leading to an intake manifold (not shown) of the internal combustion engine 22. The supercharger system 20 also includes a lubrication circuit 48, which has a pump 50 and a cooler 52. The fluid in the lubrication circuit can be oil or transmission fluid.

Figure 2:
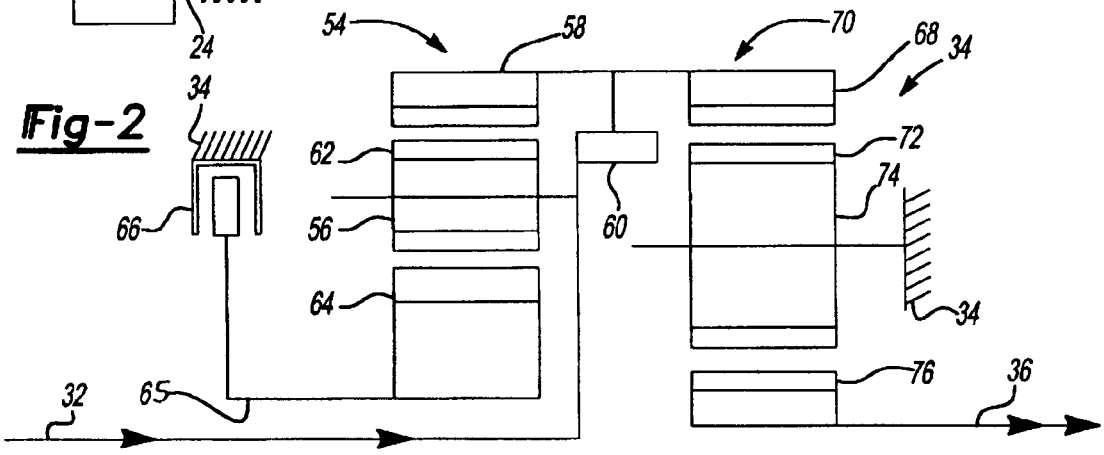
FIG. 2 is a schematic representation of the interior of the gearbox of FIG. 1.

FIG. 2 illustrates the components internal to the gear box 34. The input shaft 32 drives a first planetary gear set 54. More particularly, the input shaft 32 is coupled to and drives a first planet carrier 56, and is also connected to a first ring gear 58 via a one way clutch 60. A first set of planet gears 62, mounted in the first planet carrier 56, couple a first sun gear 64 to the first ring gear 58. An electronically controlled clutch 66 is rotationally connected, via a shaft 65, so as to allow for selectively coupling and decoupling the first sun gear 64 to the gear box 34 (which in this configuration is ground). The first ring gear 58 is rotationally fixed to second ring gear 68 of a second planetary gear set 70. The second ring gear 68 engages a second set of planet gears 72, which are mounted on a second planet carrier 74. This second planet carrier 74 is held (rotationally fixed relative to the gear box 34). The second set of planetary gears 72 also engage a second sun gear 76, which is rotationally fixed to the output shaft 36. An example of gear ratios for the two planetary gear sets that one may use is a ratio of ring gear teeth to sun gear teeth of 1.4 on the first planetary gear set 54, and a ratio of ring gear teeth to sun gear teeth of 5 on the second planetary gear set 70. Of course, the actual ratio for a given vehicle will depend upon the size of the engine, the ratio at the drive pulley 28 and the amount of supercharger boost desired, among other factors. For a typical engine, if one has a pulley ratio of 2:1, then the ratio of output to input speed might be 5:1 for the lower gear ratio and 10:1 for the higher gear ratio.

Figure 3:
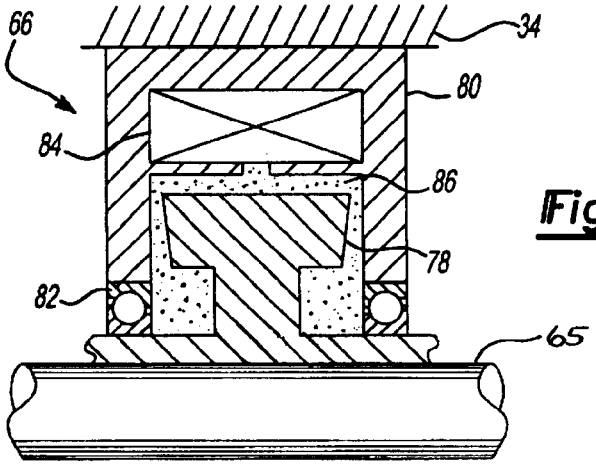
FIG. 3 is a is a schematic representation of the clutch of FIG. 2.

FIG. 3 shows a schematic diagram of the shift clutch 66, which in this embodiment is an electromagnetic particle clutch. The clutch 66 includes a rotor 78, which is rotationally fixed to the shaft 65, and a stator 80, which is coupled to the rotor 78 via bearings 82. A coil 84 is mounted to the stator 80, which are both rotationally fixed relative to the gear box 34. The annulus between the rotor 78 and the stator 80 is filled with an iron powder 86.

The operation of the supercharger system 20 will now be described with reference to FIGS. 13. When the first sun gear 64 is held (rotationally fixed relative to the gear box 34) by the clutch 66, as the input shaft 32 drives the first planet carrier 56, the first planetary gear set 54 in cooperation with the second planetary gear set 70 causes the output shaft 36 to rotate in the opposite direction and at a significantly higher rotational velocity than the input shaft 32. On the other hand, when the clutch 66 is not activated, the input shaft 32 drives the first planet carrier 56, and since the first sun gear 64 is not held the one way clutch engages. This causes the first and second planetary gear sets 54, 70 to rotate the output shaft 36 again in a reverse direction from the input shaft 32 and at a higher rotational velocity, but a significantly lower velocity than when the clutch 66 is engaged.

This system is particularly advantageous when mounted on an engine in a vehicle. As the vehicle starts accelerating from a stop, or slow speed at high throttle angle, the controller 35 activates the clutch 66 and keeps it engaged, so the centrifugal pump 40 is being driven at the higher gear ratio. When the engine is running above a particular RPM range, the controller 35 leaves the clutch off, so the centrifugal pump 40 is driven at the lower gear ratio. But during the transition between the clutch 66 remaining on and the clutch 66 remaining off, the controller 35 modulates the clutch 66 on and off. By modulating the clutch 66 on and off, with the clutch beginning as mostly on and gradually changing to mostly off, until through a transition to the higher speed range and then leaving clutch off, one obtains a smooth transition from the initial high speed gearing to the low speed gearing. Or, as an alternative, the controller 35 actuates the clutch 66 to allow for controlled slippage to progressively engage or release the clutch 66. By modulating the clutch 66, undesirable discontinuities in the engine torque and horsepower during the transition from low speed to high speed can be avoided.

Also, while the engine is operating, the oil cooling circuit 48 operates. The pump 50 pumps oil, or transmission fluid if so configured, from the gear box 34, through a cooler 52, and back into the gear box 34 in order to cool and lubricate the gears and clutches.

Figure 4:
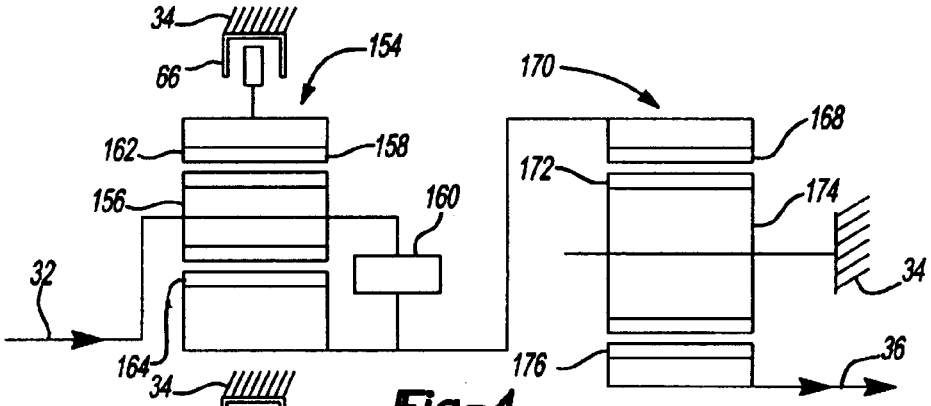
FIG. 4 is a second embodiment of the interior of the gearbox of FIG. 2 in accordance with the present invention.

A second embodiment of the gear set is shown in FIG. 4. For this embodiment, similar elements are similarly designated to those in FIG. 2, but with a 100 series number. The input shaft 32 is rotationally connected to the planet gear carrier 156 of the first planetary gear set 154. The planet gear carrier 156 mounts the planet gears 162, which engage with the first sun gear 164, and the first ring gear 158. The first ring gear 158 is selectively restrained by the clutch 66. The clutch 66 is again grounded to the gear box 34. The first sun gear 164 is rotationally fixed to and drives the second ring gear 168 on the second planetary gear set 170. A one way clutch 160 also couples the first planet carrier 156 to the second ring gear 168. The second ring gear 168 engages the second set of planetary gears 172, whose planet carrier 174 is grounded to the gear box 34. The second set of planetary gears 172, in turn, engages the second sun gear 176, which is rotationally coupled to and drives the output shaft 36. The operation of this embodiment is similar to that of the first where, when the clutch is engaged, the output shaft 36 rotates in the opposite direction to the input shaft 32, but at a significantly higher rotational speed, and when the clutch is not engaged, the output shaft 36 also rotates in the opposite direction and at a higher speed than the input shaft 32, but at a lower speed than when the clutch is engaged.

Figure 5:
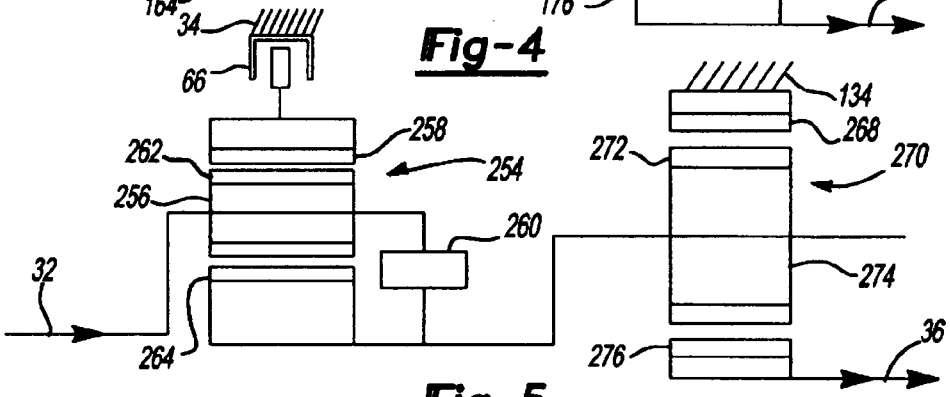
FIG. 5 is a third embodiment of the interior of the gearbox of FIG. 2 in accordance with the present invention.

A third embodiment of the gear set is shown in FIG. 5. For this embodiment, similar elements are similarly designated, but with a 200 series number. The input shaft 32 is rotationally connected to the planet gear carrier 256 of the first planetary gear set 254. The planet carrier 256 mounts the planet gears 262, which engage with the first sun gear 264, and the first ring gear 258, which is selectively restrained by the clutch 66. The clutch 66 is again grounded to the gear box 34. The first sun gear 264 is rotationally fixed to and drives the second planet gear carrier 274 on the second planetary gear set 270. A one way clutch 260 also couples the first planet carrier 256 to the second planet gear carrier 274. The second planet carrier 274 mounts the second set of planetary gears 272, which engage the second ring gear 268, which, in turn, is rotationally held by the gear box 34. The second set of planetary gears 272 also engage the second sun gear 276, which is rotationally coupled to and drives the output shaft 36. The operation of this embodiment is similar to that of the first and second, except the output shaft 36 now rotates in the same direction as the input shaft 32.

Figure 6:
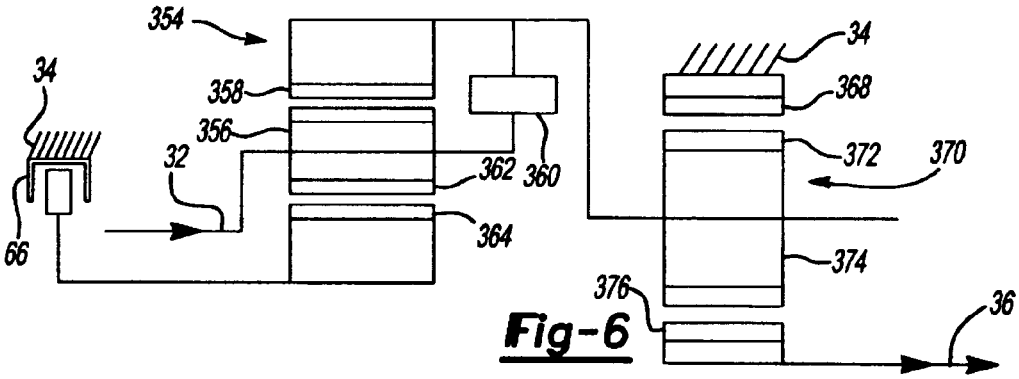
FIG. 6 is a fourth embodiment of the interior of the gearbox of FIG. 2 in accordance with the present invention.

A fourth embodiment of the gear set is shown in FIG. 6. For this embodiment, similar elements are similarly designated, but with a 300 series number. The input shaft 32 is rotationally connected to the planet gear carrier 356 of the first planetary gear set 354. The planet carrier 356 mounts the planet gears 362, which, in turn, engage with the first sun gear 364. The first sun gear 364 can be rotationally held by the clutch 66. The clutch 66 is grounded to the gear box 34. The planet gears 362 also engage the first ring gear 358, which is rotationally coupled to the second planet carrier 374 of the second planetary gear set 370. A one way clutch 360 is connected between the first planet carrier 356 and the first ring gear 358. The second planet carrier 374 mounts the second set of planetary gears 372, which engage with the second ring gear 368, which is, in turn, rotationally grounded to the gear box 34. The second set of planetary gears 372 also engage with the second sun gear 376, which is rotationally coupled to and drives the output shaft 36. The operation of this arrangement is similar to that shown in FIGS. 2 and 4, but with the rotation of the output shaft 36 in the same direction as the input shaft 32.

Figure 7:
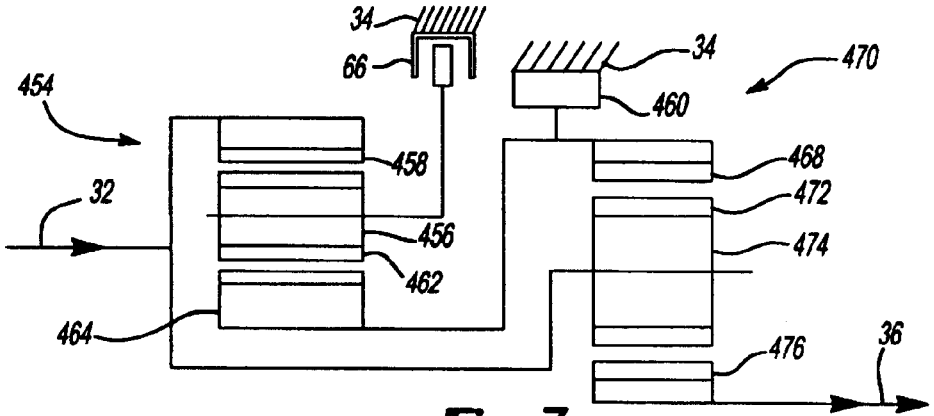
FIG. 7 is a fifth embodiment of the interior of the gearbox of FIG. 2 in accordance with the present invention.

A fifth embodiment of the gear set is shown in FIG. 7. For this embodiment, similar elements are similarly designated, but with a 400 series number. The input shaft 32 is rotationally coupled to the first ring gear 458 of the first planetary gear set 454 and to the second planet carrier 474 of the second planetary gear set 470. The first ring gear 458 engages the first set of planet gears 462, which are mounted on the first planet carrier 456. The first planet carrier 456 is coupled to the clutch 66, which is selectively grounded to the gear box 34. The first set of planet gears 462 engage the first sun gear 464, which, in turn, is rotationally coupled to the second ring gear 468. The second ring gear 468 is coupled to a one way clutch 460, which is grounded to the gear box 34, and also engages the second set of planet gears 472. The second set of planet gears 472 are mounted on the second planet carrier 474 and engage the second sun gear 476, which, in turn, couples to and drives the output shaft 36. The operation of this embodiment is similar to the previous embodiments with the output shaft rotating in the same direction as the input shaft.

Figure 8:
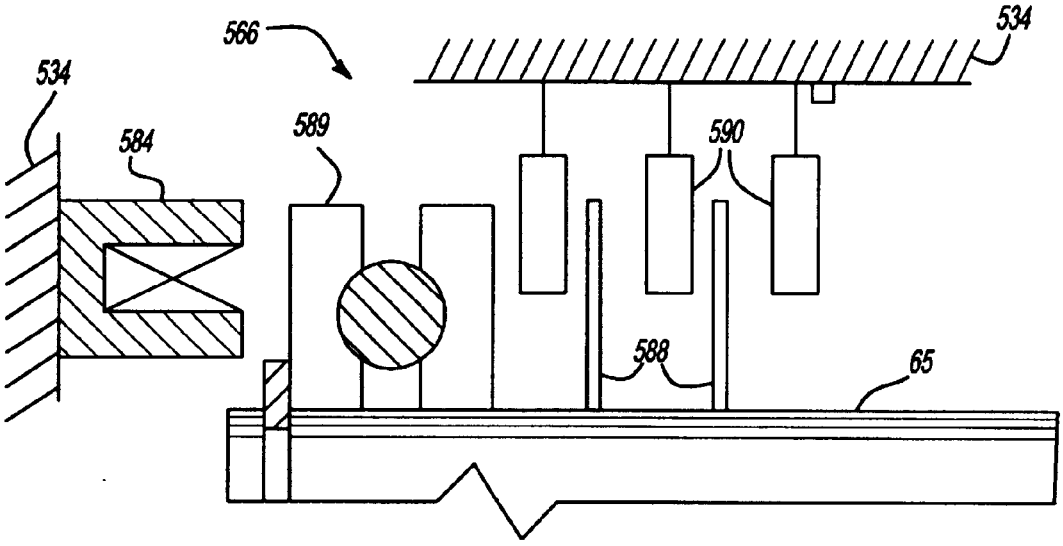
FIG. 8 is a second embodiment of the clutch of FIG. 3 in accordance with the present invention.

A second embodiment of the electronically controllable clutch is shown in FIG. 8, which, in this embodiment, is an electric ball/ramp clutch. For this embodiment, similar elements are similarly designated, but with a 500 series number. The clutch 566 rotationally couples to the shaft 65 via clutch discs 588 and a ball/ramp mechanism 589. Corresponding clutch plates 590 are interleaved with the clutch discs 588 and rotationally fixed to the gear box 534. A coil 584 is also mounted to the gear box 534. By activating the coil 584, the clutch 566 will rotationally fix the shaft 65 to the gear box (ground) 534.

Figure 9:
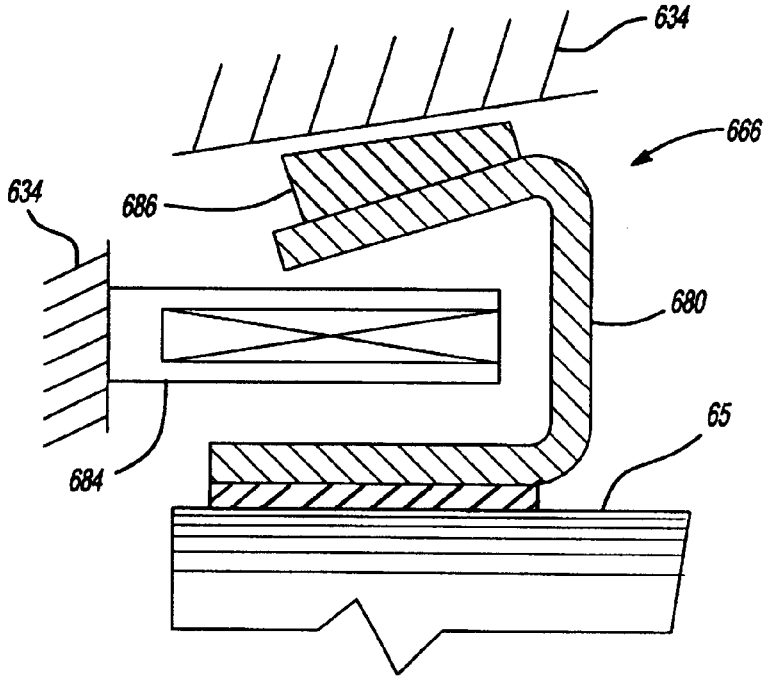
FIG. 9 is a third embodiment of the clutch of FIG. 3 in accordance with the present invention.

A third embodiment of the electronically controllable clutch is shown in FIG. 9, which in this embodiment is an electric cone clutch. For this embodiment, similar elements are similarly designated, but with a 600 series number. The clutch 666 rotationally couples to the shaft 65 via a U-shaped stator member 680. The stator member 680 includes friction material 686 that is adjacent to a surface of the gear box 634. A coil 684 also mounts to the gear box 634. When the coil 684 is activated, the friction material 686 comes into contact with the wall of the gear box 634 and grounds the shaft 65 to the gear box 634.

While certain embodiments of the present invention have been described in detail, those familiar with the art to which this invention relates will recognize various alternative designs and embodiments for practicing the invention as defined by the following claims. For example, there are other gear set configurations and other controllable clutches that can be used to drive the engine supercharger.

What is claimed is:

1. A system for variably controlling the rotational velocity input to a supercharger compressor that is operatively coupled to an internal combustion engine, the system comprising:

an input member adapted to couple to a rotating member of the engine;

a first planetary gear set including a first sun gear, a first ring gear, and a first planet carrier having a first set of plane gears mounted thereon and meshing with the first sun gear and the first ring gear, with one of the first sun gear, the first ring gear and the first planet carrier rotationally coupled to the input shaft;

a clutch mechanism having a first portion that is rotationally fixed relative to the engine, and a second portion that is selectively rotationally fixed relative to the first portion, with the second portion being rotationally coupled to one of the first sun gear, the first ring gear and the first planet carrier that is not coupled to the input shaft;

a one-way clutch coupled between one of the first sun gear, the first ring gear and the first planet carrier that is coupled to the input shaft, and another of the first sun gear, the first ring gear and the first planet carrier that is at coupled to the input shaft;

a second planetary gear set including a second sun gear, a second ring gear and a second planet carrier having a second set of planetary gears mounted thereon and meshing with the second sun gear and the second ring gear, with one of the second sun gear, the second ring gear and the second planet carrier rotationally fixed to one of the first sun gear, the first ring gear and the first planet carrier that is not directly rotationally coupled to the input shaft;

an output member adapted to couple to an input shaft to a supercharger and coupled to one of the second sun gear, the second ring gear and the second planet carrier; and a controller for selectively actuating the clutch mechanism.

2. The system of claim 1 wherein the controller includes electronics for variably controlling the clutch during transition back and forth between different gear ratios.

3. The system of claim 1 wherein the clutch mechanism is an electromagnetic particle clutch.

4. The system of claim 1 wherein the clutch mechanism is an electric ball/ramp clutch.

5. The system of claim 4 wherein the clutch mechanism is an electric cone clutch.

6. The system of claim 1 wherein the input shaft is coupled to the first planet carrier, the clutch mechanism is coupled to the first sun gear, the one-way clutch is coupled between the first planet carrier and the first ring gear, the second plant carrier is held from rotating, and the second sun gear is coupled to the output member.

7. The system of claim 1 wherein the input shaft is coupled to the first planet carrier, the clutch mechanism is coupled to the first ring gear, the one-way clutch is coupled between the first planet carrier and the first sun gear, the second planet carrier is held from rotating, and the second sun gear is coupled to the output member.

8. The system of claim 1 wherein the input shaft is coupled to the first planet carrier, the clutch mechanism is coupled to the first ring gear, the one-way clutch is coupled between the first planet carrier and the fir sun gear, the second ring gear is held from rotating, and the second sun gear is coupled to the output member.

9. The system of claim 1 wherein the input shaft is coupled to the first planet carrier, he clutch mechanism is coupled to the first sun gear, the one-way clutch is coupled between the first planet carrier end the first ring gear, the second ring gear is held from rotating, and the second sun gear is coupled to the output member.

10. A system for driving the input to a supercharger pump coupled to an internal combustion engine the system comprising:

an input member for receiving input torque from a rotating member of the engine;

a gear set for shifting between a higher gear ratio and a lower gear ratio with the gear set including a first planetary gear set coupled to the input member, and a second planetary gear set coupled to the first planetary gear set;

a clutch for causing the shifting between the higher gear ratio and the lower gear ratio;

a controller coupled to the clutch for variably controlling the clutch during shifting back and forth between the higher gear ratio and the lower gear ratio to provide a smooth transition in torque output of the internal combustion engine; and an output member couple to the second planetary gear set and adapted to couple to the supercharger pump for driving the supercharger pump.

11. The system of claim 10 wherein the clutch is an electromagnetic particle clutch.

12. The system of claim 10 wherein the clutch is an electric ball/ramp clutch.

13. The system of claim 10 wherein the clutch is an electric cone clutch.

14. A method for controlling the input speed to a drive shaft of a supercharger pump coupled to an internal combustion engine comprising the steps of:

receiving input torque from a rotating member of the engine;

providing a gear set shiftable between a higher gear ratio and a lower gear ratio;

providing a clutch for causing a shift between the higher gear ratio and lower gear ratio;

variably controlling the clutch by varying limited slip in the clutch while shifting back and forth between the higher gear ratio and the lower gear ratio to provide a smooth transition in torque output for the internal combustion engine; and providing an output member coupled between the gear set and the supercharger pump.

* * * * *